United States Patent [19]

Speak et al.

[11] 4,297,229

[45] Oct. 27, 1981

[54] PARTICULATE BORATE-SOAP COMPOSITIONS

[75] Inventors: Richard C. Speak; Donald J. Ferm, both of Fullerton, Calif.

[73] Assignee: United States Borax & Chemical Corporation, Los Angeles, Calif.

[21] Appl. No.: 87,377

[22] Filed: Oct. 23, 1979

[51] Int. Cl.[3] ..... C11D 9/16; C11D 11/00; C11D 17/06

[52] U.S. Cl. ..... 252/109

[58] Field of Search ..... 252/108, 109, 132

[56] References Cited

U.S. PATENT DOCUMENTS

| | | | |
|---|---|---|---|
| 60,890 | 1/1967 | Hermance | 252/109 |
| 1,560,626 | 11/1925 | Welter | 252/108 |
| 2,142,180 | 1/1939 | Crites | 252/109 |
| 2,316,689 | 4/1943 | Heald et al. | 252/109 |
| 2,376,096 | 5/1945 | Snell | 252/109 |
| 2,664,399 | 12/1953 | Kluender | 252/18 |
| 2,964,472 | 12/1960 | Blum | 252/18 |
| 3,020,237 | 2/1962 | Dunn | 252/109 |
| 3,216,946 | 9/1965 | Curtin | 252/156 |
| 3,886,087 | 5/1975 | Terry | 252/370 |

FOREIGN PATENT DOCUMENTS

| | | | |
|---|---|---|---|
| 16828 | 3/1934 | Australia | 252/109 |

OTHER PUBLICATIONS

Soap, "Borax Soaps", Nov. 1935, pp. 65, 67.

*Primary Examiner*—P. E. Willis, Jr.
*Attorney, Agent, or Firm*—James R. Thornton

[57] ABSTRACT

Particulate borate-soap compositions containing sodium bicarbonate are produced by reaction of a fatty acid with a mixture of hydrated sodium tetraborate and alkali metal carbonate in a fatty acid: carbonate mole ratio of about 1:1 to 1:2. The product comprises particles of borate coated with soap and sodium bicarbonate in which the soap represents about 5 to 35% by weight of the composition.

20 Claims, No Drawings

PARTICULATE BORATE-SOAP COMPOSITIONS

This invention relates to a process for producing a particulate borate soap composition and to an improved borate soap composition which is especially useful as a hand cleanser.

BACKGROUND OF THE INVENTION

The use of borates, and especially borax, in hand and laundry soap compositions goes back many years. For example, see U.S. Pat. No. 60,890 which was granted in 1867, as well as U.S. Pat. Nos. 2,316,689, 3,020,237 and 3,886,087 which disclose preparation of soap compositions containing borax. Powdered hand soap compositions which are mixtures of a major amount of particulate borax and minor amount of milled soap are well-known to the art. Products such as BORAXO ® Powdered Hand Soap have been used for many years in soap dispensers as a convenient and economical means of providing an alternative to bar soap. The soap is generally made by saponification of animal or vegetable fats or reaction of fatty acids obtained from such fats with caustic soda or caustic potash (sodium or potassium hydroxide) and then mixed with the particulate borax.

It has also been proposed that soap may be manufactured by reaction of fatty acids with sodium carbonate. See, for example, Reinish, *Journal of the American Oil Chemists Society,* 29, No. 11, pages 506–510 (1952). The mol ratio of fatty acid to sodium carbonate may vary from about 1:0.5 to 1:1 and such mol ratio determines the by-products obtained, either sodium bicarbonate or carbon dioxide. Several patents describe the production of soap by the addition of fatty acids to sodium carbonate. After the addition of fatty acid is completed, it has been suggested that relatively small amounts of detergent builders such as the phosphates, silicates, sodium sulfate, borates, etc. can be added to the composition. See British Pat. No. 473,220 and U.S. Pat. Nos. 2,992,992, 3,216,946 and 3,956,160. The reaction of fatty acids with caustic soda in the presence of known detergent additives has also been suggested. See British Pat. No. 376,098 and U.S. Pat. No. 2,664,399. According to U.S. Pat. No. 2,664,399, borax as well as detergent additives such as phosphates and soda ash may be present during reaction of the fatty acid with caustic soda or KOH.

DESCRIPTION OF THE INVENTION

The present invention provides a method of producing an improved particulate borate soap composition which provides a homogeneous, free-flowing product having excellent sudsing and cleaning properties. The process of the present invention comprises heating a fatty acid or mixture of fatty acids having about 8 to 18 carbon atoms to an elevated temperature at which the fatty acid is a liquid, such as at about 40° to 100° C. The liquid fatty acid is then intimately mixed with a mixture of finely divided alkali metal carbonate and hydrated sodium tetraborate, thereby forming the alkali metal salt of the fatty acid and producing a particulate sodium tetraborate-soap-alkali metal bicarbonate composition. Preferably, the liquid fatty acid is sprayed onto the mixing carbonate-borate blend. The mole ratio of the fatty acid to alkali metal carbonate must be in the range of from 1:1 to about 1:2, and preferably is about 1:1.1–1.3.

The alkali metal carbonate may be sodium or potassium carbonate, but sodium carbonate is preferred as the most economical reactant. The carbonate is substantially of a particle size smaller than about 100 mesh, and preferably smaller than about 200 mesh. Although the hydrated forms of alkali metal carbonate may be used, the anhydrous form is preferred.

The hydrated sodium tetraborate may be sodium tetraborate pentahydrate, sodium tetraborate decahydrate (borax) or mixtures thereof, and preferably has a particle size distribution in the range of about 10 to 325 mesh with about 60 to 200 mesh being most preferred. The ratio of carbonate to tetraborate in the reaction mixture is adjusted so as to produce a final product containing about 25 to 50% sodium tetraborate (on an anhydrous basis).

The fatty acids which may be employed in the present process are those derived from animal and vegetable oils such as beef tallow, coconut, palm kernel, corn, soybean, and peanut oils. Such fatty acids generally contain 8 to about 18 carbon atoms and are well-known to those skilled in the art. They may be saturated or unsaturated, but the saturated compounds are generally preferred. The preferred fatty acids employed in the present invention are derived from commercially available blends of tallow and coconut oils, containing about 85% tallow and 15% coconut oil. The fatty acid content of beef tallow and coconut oil is as follows:

| Fatty Acid | Carbon Atoms | Coconut Oil | Beef Tallow |
|---|---|---|---|
| Caproic | 6 | Trace | — |
| Caprylic | 8 | 8.0% | — |
| Capric | 10 | 7.0 | — |
| Lauric | 12 | 48.0 | — |
| Myristic | 14 | 17.5 | 3–7% |
| Palmitic | 16 | 8.8 | 30 |
| Stearic | 18 | 2.0 | 20–21 |
| Oleic | 18 | 6.0 | 45 |
| Linoleic | 18 | 2.5 | 1–3 |

Other ingredients may be added to the reaction mixture to obtain various desirable properties such as perfumes, dyes, lanolin, urea, etc. When such additives are liquids, they may be conveniently dissolved or dispersed in the hot liquid fatty acid for ease of addition. Additives may also be blended into the carbonate-borate mixture prior to reaction with the fatty acid, if desired.

In a preferred procedure according to this invention, the warm liquid fatty acid is added to and intimately mixed with the mixture of alkali metal carbonate and hydrated sodium tetraborate in a mixing apparatus which provides rapid and complete blending of the reactants. Such mixers are available from various manufacturers and can have different configurations. For example, one may use the Patterson-Kelley twin shell blender in which the mixing action is achieved by rotating the V-shaped vessel around a horizontal axis. Preferably, the blender is equipped with an intensifier bar which is useful in blending dry components prior to liquid addition and also provides the capability to spray the liquid onto the solids in an efficient manner.

The reaction product may continue mixing in the reactor or may be transferred to a conditioner for a time sufficient to substantially complete the reaction of the alkali metal carbonate with the fatty acid. Such conditioning may consist of continued agitation in a blender or mixing apparatus such as a ribbon blender, a Sigma blade mixer, or other mixing apparatus. Preferably, a shearing type mixer or blender is used for the conditioning step. Conditioning may also be accomplished under static conditions, i.e., merely allowing the product to stand for a period of time. In this method, the product resulting from the initial mixing step is held in a static condition for from about 5 to about 120 minutes, during which time the neutralization reaction goes to substantial completion. During this conditioning phase, the product may be heated up to about 55° C., if desired, to minimize the conditioning time. The product resulting from this procedure is a substantially solid, friable mass which can be reduced to the desired particle size by suitable size reduction equipment. It is advantageous to control the depth of product during this static conditioning process to facilitate further handling. For example, product spread in a layer about 1 to about 12 inches deep on a stationary or moving surface (as on a conveyor belt) would facilitate the subsequent handling process as compared to simply dumping the product to a bin where subsequent removal might be difficult.

It has been found to be advantageous in some cases to add a small amount, such as up to about 2% by weight, of water to the reaction mixture, preferably after the addition of the fatty acid is completed, especially when static conditioning is employed. Such addition of water can accelerate the reaction of the alkali metal carbonate with the fatty acid and provide a more rapid throughput in a continuous procedure. It can be added to the reaction apparatus or to the conditioner.

The resultant product consists of a sodium tetraborate particle which is coated with a mixture of soap and alkali metal bicarbonate and possibly a small amount of carbonate if an excess is present. The soap content of the product is in the range of from about 5 to about 35% by weight, and preferably is about 10 to 25%. It is preferred that the product be milled to obtain a maximum particle size of about −30 mesh, preferably with no more than about 25% being −200 mesh. Although such milling can alter the configuration of some particles, each particle still has soap associated with it after milling; yet, they may not all be completely coated with soap.

The product is a dry, free-flowing particulate composition which is suitable for use in powdered soap dispensers. It has been found that the product of this invention gives faster and more copious sudsing than with previously available borate soap powdered hand cleansers which are physical mixtures of the borax particles and milled soap. if desired, the higher soap content products of this invention can also be compressed and shaped such as into bars.

The following examples illustrate the process and product of the invention.

EXAMPLE 1

Sodium tetraborate pentahydrate (14 lb., 7 oz.) and 1 lb., 14 oz. of anhydrous sodium carbonate (−200 mesh) were blended in a Patterson-Kelley V-shaped blender for 5 minutes. The borax·5 mol had a particle size described as +8 mesh and the majority of the particles were in the range of about 30 to 100 mesh. A mixture of fatty acids derived from beef tallow and coconut oil (85:15 percent by weight) was heated to about 60° C. and sprayed onto the mixing borate-carbonate by use of a heated intensifier bar. The addition of the fatty acid required about 3 minutes and mixing was then continued for an additional one minute. The resultant product was trasnferred to a Sigma mixer and conditioned by mixing for approximately 12 minutes to give a dry, free-flowing product. A petroleum ether extract of the product was analyzed and was found to contain no unreacted fatty acid. The resultant produce contained 20% soap and had the following screen analysis (average of three samples):

| Mesh | % Retained on Screen (Cumulative) |
|---|---|
| 30 | 36.5 |
| 40 | 58.3 |
| 60 | 78.4 |
| 80 | 85 |
| 100 | 88.4 |
| 200 | 94.9 |
| −200 | 100 |

EXAMPLE 2

14 lb., 7 oz. of 30–200 mesh sodium tetraborate decahydrate and 1 lb., 14 oz. anhydrous sodium carbonate (31 100 mesh) were combined in a Patterson-Kelley 16 quart twin shell blender and blended for 5 minutes. The intensifier/liquid dispersion bar which had previously been pre-heated in an oven set at 100° C. was inserted. Both blender shell and intensifier bar drives were started and 3 lb., 11 oz. of the fatty acid of Example 1 at 77° C. were added through the intensifier bar. Acid addition required about 2 minutes. The blender shell was allowed to run for an additional one minute, then the product was discharged from the Patterson-Kelley blender into a paddle type mixer. Mixing was started and 25 milliliters of water at about 90° C. were sprayed onto the mixing mass. After about 17 minutes, the product became dry and free-flowing with a few lumps. Mixing was continued for a total mix time of 30 minutes, after which the product was discharged. Analysis for unreacted fatty acid showed the neutralization reaction to be substantially complete.

EXAMPLE 3

An experiment was run using the amounts of material specified above and substantially the same procedure. However, following the fatty acid addition, 50 ml. of water at about 90° C. were added to the reaction mixture through the rotating intensifier/liquid dispersion bar. The bar was blown out with compressed air and the bar drive turned off. After an additional one minute of blending, the product was dumped from the mixer and transferred to a paddle type mixer. After about 13 minutes of mixing the product began to become dry and free-flowing. After 30 minutes of mixing, product was discharged from the mixer. At this time it was dry and free-flowing with a few lumps. Analysis for unreacted fatty acid showed the neutralization reaction to be substantially complete.

EXAMPLE 4

A 20% soap product was made in a continuous fashion using a Patterson-Kelley 8-inch continuous Zig-Zag mixer. The feed to the mixer was 30/200 mesh sodium tetraborate decahydrate at 18.05 lb/min, −200 mesh sodium carbonate (anhydrous) at 2.35 lb/min. and the fatty acid of Ex. 1 at 42° C. at 4.60 lb/min. Product exiting the mixer at about 25 lb/min. was similar in appearance to that of soft sugar with fragile lumps, with a density of about 31 lb/ft$^3$ and had a temperature of 42°

C. 250 lb. of product was collected and transferred to a 20 liter capacity Patterson-Kelley Gardner Horizontal Mixer with free-flow type agitator. While mixing at 80 rpm, 5 pounds of water were added in about 2½ minutes. Agitation was continued for 5 minutes, at which time the product began to become free-flowing. The mixer was stopped momentarily, then mixing continued for an additional 5 minutes, and the product was discharged. Product at this point was dry and free-flowing and had a bulk density of about 60 lb/ft$^3$. Particle size of this material was found to be the following:

| U.S. Screen Size | % Retained on Screen (Cumulative) |
|---|---|
| 20 | 30.6 |
| 30 | 45.4 |
| 40 | 63.6 |
| 70 | 93.8 |
| 100 | 98.3 |
| 200 | 99.5 |
| through 200 | 0.5 |

This product was run through a Pulvacron mill where it was ground without difficulty to give the following particle size distribution:

| U.S. Screen Size | % Retained on Screen |
|---|---|
| 20 | 1.3 |
| 30 | 4.2 |
| 40 | 12.6 |
| 70 | 52.2 |
| 100 | 67.8 |
| 200 | 85.5 |
| through 200 | 14.5 |

EXAMPLE 5

A 15% soap product was made in a continuous fashion using a Patterson-Kelley 8-inch continuous Zig-Zag mixer. The feed to the mixer was 19.80 lb/min. of 30/200 borax, 1.75 lb/min. of −200 mesh anhydrous sodium carbonate and 3.45 lb/min. of a blend of $C_{8-18}$ fatty acids at 52° C. Product discharged from the mixer with a bulk density of 38.8 lb/ft$^3$ at 25 lb/min. About 270 lb. of product was transferred to a Patterson-Kelley Gardner Horizontal Mixer with an interrupted ribbon agitation. 5.4 lb. of water was sprayed in during a 4-minute mixing period. The mixer was then shut off and product allowed to sit for 10 minutes after which the mixer was started and the free-flowing product discharged at 55.8 lb/ft$^3$ bulk density. This product had the following particle size distribution:

| U.S. Screen Size | % Retained on Screen (Cumulative) |
|---|---|
| 20 | 17.0 |
| 30 | 24.7 |
| 40 | 42.8 |
| 70 | 87.4 |
| 100 | 95.6 |
| 200 | 99.0 |
| through 200 | 1.0 |

After a single pass through a Pulvacron grinder, the product had the following particle size distribution:

| U.S. Screen Size | % Retained on Screen (Cumulative) |
|---|---|
| 20 | 0.2 |
| 30 | 0.7 |
| 40 | 4.2 |
| 70 | 42.9 |
| 100 | 61.1 |
| 200 | 84.2 |
| through 200 | 15.8 |

In a continuation of this example, the continuous mixer was run as indicated above but with the simultaneous addition of 0.5 lb/min. water. The product discharged freely from the mixer at 43.9 lb/ft$^3$ bulk density. This product was found to be much dryer when discharged from the mixer than in the earlier part of the run where no water was added. The neutralization reaction was essentially completed, as indicated by an analysis for unreacted fatty acid. Product was placed immediately into a 5 cubic foot capacity bin with an inverted cone live bottom and allowed to stand undisturbed for 2½ hours, after which the product was found to deliver freely from the bin.

EXAMPLE 6

A 25% soap product was prepared in a 16 qt. Patterson-Kelley twin shell mixer. 13 lb., 1 oz. of 30/200 borax and 2 lb., 5 oz. of −200 mesh anhydrous sodium carbonate were placed in the mixer and blended for 5 minutes. The mixer was stopped and the intensifier/liquid dispersion bar which had been pre-heated in a 100° C. oven was inserted. Both the mixer and intensifier bar drives were engaged and 4 lb., 10 oz. of a blend of $C_8$–$C_{18}$ acids at 49° C. were added through the intensifier bar. Acid addition required about 3 minutes. The intensifier bar was blown out with compressed air and its drive mechanism turned off. The mixer was run for about one additional minute, after which the mixer was stopped and the product dumped. Product was transferred to a Kneadermaster mixer (Patterson Industries, Inc.) where it was mixed for 10 minutes. The mixer was run at about 75 rpm. The product was found to become dry and free-flowing after about 8 minutes of mixing time had elapsed. At this time, product was discharged from the mixer. Particle size of this product was found to be as follows:

| U.S. Screen Size | % Retained on Screen (Cumulative) |
|---|---|
| 20 | 17.6 |
| 30 | 31.8 |
| 40 | 54.2 |
| 70 | 90.9 |
| 100 | 96.7 |
| 200 | 99.0 |
| through 200 | 1.0 |

As described above, the present method provides a process for making an improved borate-soap composition. The process may be operated as a batch or continuous process. In operating as a continuous process, we have found that, when the product contains more than about 20% soap, it is desirable to dilute the boratecarbonate feed mixture with previously prepared product, in amounts such as up to about 50% by weight, of the feed. Such dilution helps prevent the formation of sticky product which is more difficult to handle.

Various changes and modifications of the invention can be made, and to the extent that such variations incorporate the spirit of this invention, they are intended to be included within the scope of the appended claims.

What is claimed is:

1. The method of producing a particulate borate soap composition comprising heating $C_8$–$C_{18}$ fatty acid at a temperature of from about 40° to 100° C. at which temperature said fatty acid is a liquid and intimately mixing said liquid fatty acid with a mixture of finely divided alkali metal carbonate and hydrated sodium tetraborate to form the alkali metal salt of said fatty acid and thereby produce a particulate hydrated sodium tetraborate-soap-alkali metal bicarbonate composition containing about 25 to 50% as anhydrous sodium tetraborate, wherein the mole ratio of said fatty acid to alkali metal carbonate is in the range of from 1:1 to about 1:2, said finely divided alkali metal carbonate is substantially of a particle size smaller than 100 mesh, and the soap content of the resultant particulate product is in the range of about 5 to 35% by weight.

2. The method of claim 1 in which up to about 2% by weight of water is added to the reaction mixture.

3. The method of claim 1 in which said liquid fatty acid is added to said mixture of alkali metal carbonate and hydrated sodium tetraborate and the resultant product conditioned for a time sufficient to substantially complete the formation of alkali metal salt of said fatty acid.

4. The method of claim 3 in which the conditioning is by agitating the product in a blender or mixer.

5. The method of claim 1 in which said alkali metal carbonate is anhydrous sodium carbonate having a particle size of about −200 mesh.

6. The method of claim 1 in which said hydrated sodium tetraborate is sodium tetraborate decahydrate.

7. The method of claim 1 in which said fatty acid is derived from a blend of tallow and coconut oils.

8. The method of claim 1 in which said mole ratio of fatty acid to alkali metal carbonate is about 1:1.1–1.3.

9. The method of claim 2 in which said water is added to said reaction mixture after addition of said fatty acid is completed.

10. The method of claim 1 in which said particulate product is milled to a maximum particle size of −30 mesh.

11. The method of claim 1 in which said alkali metal is sodium.

12. The method of claim 1 in which a blend of tallow and coconut fatty acids is heated to a temperature of about 65° C., added to and intimately mixed with said mixture of finely divided anhydrous sodium carbonate of about −200 mesh and sodium tetraborate decahydrate of about 60 to 200 mesh, wherein the fatty acid: sodium carbonate mole ratio is about 1:1.1–1.3 and the resultant soap content of the particulate product is about 10–25%.

13. The method of claim 12 in which up to about 2% by weight of water is added to the reaction mixture after addition of said fatty acid is completed.

14. The method according to claim 12 in which said heated fatty acid blend is sprayed on and mixed with said mixture of carbonate and tetraborate.

15. The method according to claim 1 in which said liquid fatty acid is sprayed on and mixed with said mixture of carbonate and tetraborate.

16. Particulate borate soap consisting essentially of hydrated sodium tetraborate particles coated with a mixture of soap and alkali metal bicarbonate, said borate soap containing about 5 to 35% by weight soap and about 25 to 50% anhydrous sodium tetraborate.

17. The particulate composition according to claim 16 in which about 10 to 25% soap is present.

18. The particulate composition according to claim 16 having a maximum particle size of about −30 mesh with no more than about 25% being −200 mesh.

19. The particulate composition according to claim 16 in which said mixture includes a molar amount of alkali metal carbonate.

20. The particulate composition according to claim 16 in which said alkali metal is sodium.

* * * * *

UNITED STATES PATENT OFFICE

CERTIFICATE OF CORRECTION

Patent No. 4,297,229 Dated October 27, 1981

Inventor(s) RICHARD C. SPEAK; DONALD J. FERM

It is certified that error appears in the above-identified patent and that said Letters Patent are hereby corrected as shown below:

Column 4, line 23, the words "(31 100 mesh)" should read -- (-100 mesh) -- .

In the claims, Column 8, line 38, the word "molar" should read -- minor -- .

Signed and Sealed this

Fifth Day of January 1982

[SEAL]

Attest:

GERALD J. MOSSINGHOFF

Attesting Officer

Commissioner of Patents and Trademarks